US008474781B2

(12) United States Patent
Deguglimo et al.

(10) Patent No.: US 8,474,781 B2
(45) Date of Patent: Jul. 2, 2013

(54) SHELF ITEM DISPLAY ACCESSORY

(75) Inventors: Joe Deguglimo, Boca Raton, FL (US); Glenn Robinson, Coral Springs, FL (US)

(73) Assignee: IBT Holdings, LLC, Deerfield Beach, FL (US)

( * ) Notice: Subject to any disclaimer, the term of this patent is extended or adjusted under 35 U.S.C. 154(b) by 177 days.

(21) Appl. No.: 12/910,858

(22) Filed: Oct. 24, 2010

(65) Prior Publication Data

US 2012/0097626 A1 Apr. 26, 2012

(51) Int. Cl.

| | |
|---|---|
| ***F16M 13/00*** | (2006.01) |
| *A47G 29/087* | (2006.01) |
| *G08B 13/14* | (2006.01) |
| *A47B 81/00* | (2006.01) |
| *A47B 57/00* | (2006.01) |

(52) U.S. Cl.

USPC ..... 248/551; 211/119.003; 340/568.1; 312/234.4; 108/97

(58) Field of Classification Search

USPC ..... 211/119.003, 59.3, 59.2, 4, 183, 211/90.01, 90.02, 90.04, 134; 340/568.1–568.4; 248/551; 312/234.4; 108/97, 98, 108

See application file for complete search history.

(56) References Cited

U.S. PATENT DOCUMENTS

| | | | | | |
|---|---|---|---|---|---|
| 740,236 | A | * | 9/1903 | Cohen | 211/49.1 |
| 2,713,530 | A | * | 7/1955 | Chisholm | 108/93 |
| 3,776,388 | A | * | 12/1973 | Mattheis | 211/119.003 |
| 3,949,880 | A | * | 4/1976 | Fortunato | 211/119.003 |
| 4,120,401 | A | * | 10/1978 | Newman | 206/566 |
| 4,460,096 | A | * | 7/1984 | Ricci | 211/184 |
| 4,486,169 | A | * | 12/1984 | Lewis | 431/253 |
| 5,111,942 | A | * | 5/1992 | Bernardin | 211/59.3 |
| 5,458,248 | A | * | 10/1995 | Alain | 211/175 |
| 5,673,801 | A | * | 10/1997 | Markson | 211/59.3 |
| 5,685,436 | A | * | 11/1997 | Davet | 211/85.5 |
| 6,263,603 | B1 | * | 7/2001 | Wildrick | 40/661 |
| 6,896,543 | B2 | * | 5/2005 | Fort et al. | 439/501 |
| 6,946,961 | B2 | * | 9/2005 | Frederiksen et al. | 340/568.2 |
| 7,714,722 | B2 | * | 5/2010 | Marszalek et al. | 340/568.2 |
| 8,016,139 | B2 | * | 9/2011 | Hanners et al. | 211/184 |
| 8,135,482 | B2 | * | 3/2012 | Caldwell et al. | 700/60 |
| 2004/0060883 | A1 | * | 4/2004 | Walker | 211/119.003 |
| 2005/0247649 | A1 | * | 11/2005 | Scholen et al. | 211/26 |
| 2007/0152819 | A1 | * | 7/2007 | Marszalek et al. | 340/568.4 |
| 2010/0326934 | A1 | * | 12/2010 | Goldberg | 211/85.2 |

* cited by examiner

*Primary Examiner* — Joshua J Michener
*Assistant Examiner* — Devin Barnett
(74) *Attorney, Agent, or Firm* — Steven M. Greenberg; Carey Rodriguez Greenberg O'Keefe, LLP

(57) ABSTRACT

Embodiments of the present invention provide a system and method for displaying items of goods on shelving systems. A shelf display accessory unit can include a top panel with a top surface configured for displaying an item of goods, and a bottom surface which is opposite the top surface, that includes a module that houses a cable. The shelf display accessory unit further can include a front panel having a display surface that is configured to display a label, and a back panel having a supporting surface that includes means for coupling the shelf display accessory unit to a front portion of a shelf. In embodiments, the shelf display accessory unit can include a cable that has one end anchored to the module and the other end connected to the item of goods. In embodiments, the shelf display accessory unit further can include a flap coupled to the front panel and configured to secure a label to the front panel of the shelf display accessory unit.

4 Claims, 2 Drawing Sheets

SHELF ITEM DISPLAY ACCESSORY

BACKGROUND OF THE INVENTION

1. Field of the Invention

The present invention relates to the field of shelving and more particularly to shelf item display accessory units for shelving systems.

2. Description of the Related Art

Manufacturers continue to introduce new products in a highly competitive global economy. Display shelves in the stores are often crowded with products. Consumers can easily become lost in view of the multitude of products available as the consumers encounter difficulties in choosing between similar products. At the same time, it is a challenge for the manufacturers to attract the buyers' attention and interest. Indeed, many new products, at the time they are first introduced to the consumer market, may or may not be heavily promoted in the media. In order for any store to satisfy demand for a new item, it is important that shelf space be adequate for the new item. Shelf extensions that can attach to current shelving systems are a convenient merchandising tool to extend shelf space and emphasize a particular product to consumers.

One technique to augment shelf space and/or promote specific items for sale is to display items in counter top displays near checkout areas of a store. Such displays are generally only used for smaller items and tend to clutter counter tops by interfering with the check-out process. Moreover, these standing display units are frequently for temporary use and as such they are often fragile, unsteady and can be tipped over easily.

In order to provide additional shelf space, shelf extensions have been devised in the form of open wire trays adapted to hang onto the front of a shelf. Such extensions are relatively expensive and are fairly difficult to attach or detach from a shelf. Numerous parts, requiring assembly, form such typical shelf extensions. When hangers, hooks and/or brackets are used to mount the extension on the shelf, the extension can be inadvertently dislodged due to the lack of the strength of contact with the shelf. Contact adhesive also may be used as an attachment means; however, these contact adhesives will weaken over time to cause the extension to no longer be properly mounted to the shelf.

BRIEF SUMMARY OF THE INVENTION

Embodiments of the present invention address deficiencies of the art in respect to shelving systems and provide a novel and non-obvious device, system and method for displaying items of goods on shelving systems. In one embodiment of the invention a shelf display accessory unit can be provided. The shelf item display accessory unit can include a top panel with a top surface configured for displaying an item of goods, and a bottom surface which is opposite the top surface, that includes a module that houses a cable. The shelf display accessory unit further can include a front panel having a display surface that is configured to display a label, and a back panel having a supporting surface that includes means for coupling the shelf display accessory unit to a front portion of a shelf. In embodiments, the shelf display accessory unit can include a cable that has one end anchored to the module and the other end connected to the item of goods. In embodiments, the shelf display accessory unit further can include a flap coupled to the front panel and configured to secure a label to the front panel of the shelf display accessory unit.

In one aspect of the embodiment, the means for coupling the shelf display accessory unit can include an upward turning locking lip and at least one screw to secure the shelf item display accessory unit to the shelf. In one aspect of the embodiment, the flap for securing the label to the front surface can be a spring loaded hinged flap rotatably affixed to the forward edge of the shelf display accessory unit for providing a marketing material display surface.

In another embodiment of the invention, a method for displaying an item of goods on a shelving system can be provided. The method can include providing a shelf display accessory unit, which can include a top surface adapted to display an item of goods, and a bottom surface, opposite to the top surface, having a module that houses a retractable cable. Further, the shelf display accessory unit can include a front surface for displaying a label, wherein the front surface can include a flap for securing the label to the front surface, and a back supporting surface having means for coupling the accessory to the front edge of a shelf, including an upward turning locking lip and at least one screw for coupling the accessory to the front edge of a shelf. The method further can include placing the back supporting surface of the shelf display accessory unit onto a front portion of a shelf, screwing the shelf display accessory unit onto a backside of the front portion of the shelf to secure the shelf display accessory unit to the shelf, and displaying an item of goods on the top surface of the top panel of the shelf display accessory unit. In an aspect of this method, an item of goods can be displayed on the top surface of the shelf display accessory unit. In another aspect of this method, the displayed item of goods can be connected to one end of a retractable cable, while the other end of the retractable cable is anchored to a cable module of the shelf display accessory unit.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
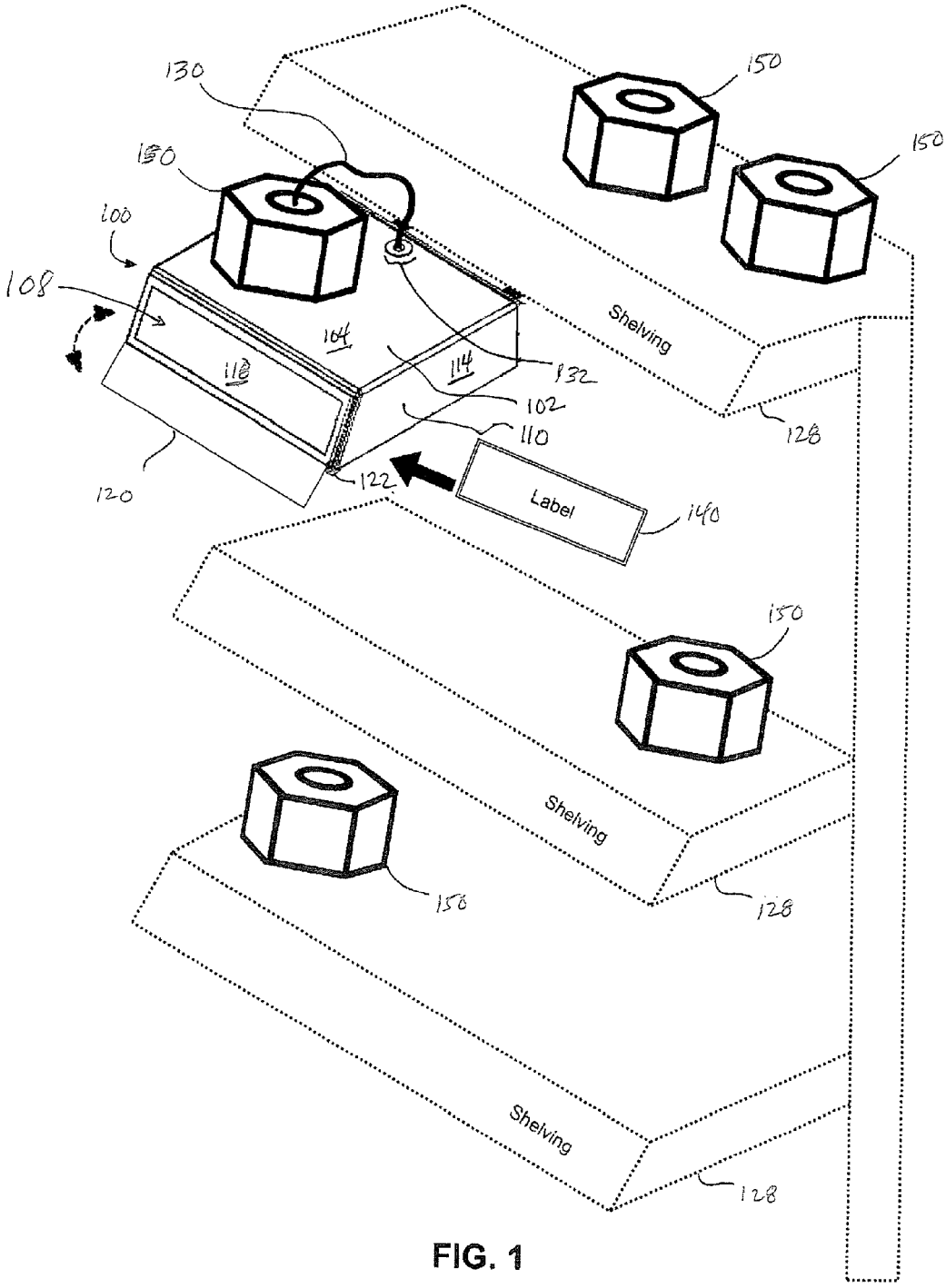
FIG. 1 is a perspective view of a shelf display accessory unit coupled to a conventional shelf.

Embodiments of the present invention provide a method and system for displaying items of goods. In one embodiment, a shelf display accessory unit which can be used to emphasize a specific item of goods in order to attract buyer attention and interest is provided. Moreover, the shelf display accessory unit is a solid and durable apparatus, easy to install with no prior assembly required.

The shelf display accessory unit can include a top surface adapted to display an item of goods, and a bottom surface, opposite to the top surface, having a module that houses a retractable cable, wherein one end of the retractable cable is anchored to the module and the other end is attached to the item of goods. The retractable cable provides a proper and secure means to display the item of goods. In fact, the displayed item can stay on the top surface of the shelf display accessory unit without falling on the floor and making a mess. As the item of goods stays attached to the shelf, it can be displayed without its packaging with a minimal risk of theft. Thus, the shelf display accessory unit provides a convenient marketing apparatus to highlight the displayed item of goods, which can be tested by the consumers. Further the shelf display accessory unit can prevent consumers from unpackaging the item of goods offered for sale before purchase. This practice is costly for the stores due to the risk that the consumers don't purchase the item or attempt to steal the item where the security is resident in the packaging of the item.

The shelf display accessory unit further can include a front panel having a front surface for displaying a label, wherein the front panel can include a flap. The flap can be a spring loaded hinged flap that can be rotatably affixed to a forward bottom edge of the shelf item display accessory unit to secure the label to the front surface. The flap can be attached to the front panel of the shelf display accessory unit without requiring assembly by users.

The shelf display accessory unit further can include a rear panel including a back supporting surface having means for coupling the accessory in front of a shelf. The means for coupling the shelf display accessory unit can include an upward turning locking lip and/or a channel bracket and at least one screw to secure the shelf display accessory unit onto a conventional display shelf. The supporting surface of the back panel of the shelf item display accessory unit can be placed on the front bottom edge of a shelf with the upward turning locking lip placed around the underneath and the back of the front bottom edge of the shelf. Once in place, the upward turning locking lip can be screwing onto the back front bottom edge of the shelf to secure the shelf item display accessory unit to the shelf. The upward turning locking lip can be provided to gravity and friction secure the shelf item display accessory to the shelf, the shelf item display accessory being directly in contact with the front of the shelf. The locking lip can be provided with the shelf item display accessory unit without requiring any assembly by the users. Thus the invention has developed an economical and easy way to use a shelf item display accessory unit providing a solid and durable apparatus, which can be moved and used to display many different goods and products.

Figure 2:
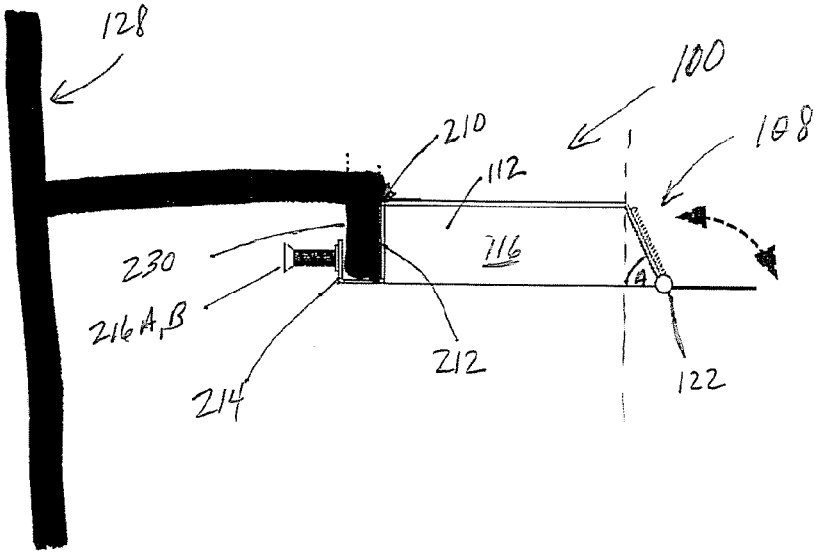
FIG. 2 is a side view of the shelf display accessory unit coupled to a conventional shelf.

In illustration, FIG. 1 is a perspective view of a shelf display accessory unit coupled to a conventional display shelf. As shown in FIG. 1, a shelf display accessory unit 100 according to the present invention can be coupled to the front edge of a conventional display shelf 128. The shelf display accessory unit 100 can include a top panel 102 having a top surface 104, which is configured to display an item of goods 150. The top panel 102 of the shelf display accessory unit 100 can also include a bottom surface 106 (shown in FIG. 3), opposite the top surface 104, having a module 310 (shown in FIG. 3) that houses a cable 130. One end of the cable 130, which in a preferred embodiment is a retractable cable, is anchored to the module 310 and the other end extends through an anchor hole 132 for connection to an item of goods 150. The shelf display accessory unit 100 further can include a front panel 108, two side panels 110, 112 and a rear panel 210 (shown in FIG. 2), each of which are attached to the top panel 102. The front panel 108, side panels 112, 114 and rear panel 210 can be made of various materials including but not limited to metal, magnetic material and/or plastic material. In embodiments, the front panel 108 can be angled so that a customer can more easily view label 140, which can be displayed on the front panel 108. For example, as illustrated in FIG. 2, the front panel 108 can have a viewing angle 'A' between 30 degrees to 90 degrees from the horizontal plane. The front panel 108 can have a display surface 118 for inserting or locating a label or display tag 140. The shelf display accessory unit 100 further can include a flap 120 connected to a front bottom edge of the front panel 108 via a hinge 122. The flap 120 can aid in securing the label 140 to the front panel 108. The hinge 122 can preferably be a spring-loaded hinge, e.g., a spring-loaded hinged flap 120. In embodiments, the shelf display accessory unit 100 can have various dimensions of height, width and length. For example, in one embodiment, the shelf display accessory unit 100 can have a length of 5.75", a width of 5.875" and a height of 1.5". In other embodiments, the shelf display accessory unit 100 can have a length of 4" to 8", a width of 4" to 10" and a height of 0.5" to 3".

Figure 3:
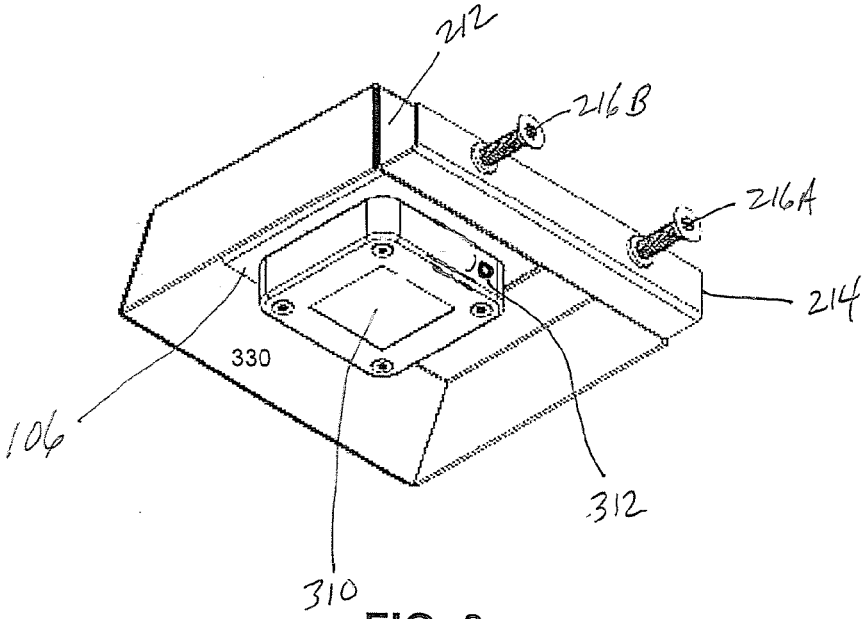
FIG. 3 illustrates a bottom perspective view of the shelf display accessory unit.

As illustrated in FIGS. 2 and 3, the shelf display accessory unit 100 can further include a back panel 210 (shown in FIG. 2) that includes a supporting surface 212 (shown in FIG. 2) having means for coupling the shelf display accessory unit 100 to a front edge 230 of a shelving system. FIG. 2 illustrates a side view of the shelf display accessory unit 100 illustrated in FIG. 1 coupled to a conventional display shelf 128. The back panel 210 having a supporting surface 212 can include means for coupling the unit 100 to a front edge 230 of conventional display shelf 128. Means for coupling the unit 100 can include an upward turning locking lip and/or a channel bracket 214 and various connectors including but not limited to at least one pressure sensitive fastener 216B such as a screw, a bolt, and the like, to secure the shelf display accessory unit 100 to the conventional shelf 128. In another embodiment, means for coupling the unit 100 can include one or more clamps mounted to a rear portion of the back panel 210 of the shelf display accessory unit 100

FIG. 3 illustrates an angled bottom view of the shelf display accessory unit 100 as shown in FIGS. 1 and 2. The shelf display accessory unit 100 further can include a back panel 210 with a back panel surface 212, which is coupled to at least one fastener, e.g., screws 216A, 216B, by an upwardly locking lip or channel bracket 214. Fasteners 216A and 216B can be used for coupling the shelf display accessory unit 100 to a front edge 230 of a conventional display shelf 128. The bottom surface 106 of top panel 102 can additionally include a retractable cable housing or module 310. The retractable cable module 310 can house a cable 130, which can be retractable or not. The cable 130 can have one end anchored to the module 310 and the other end extends from the module via a module hole 312. The cable 130 anchored to the module 310 extending from the module hole 312 can further reach the top surface 104 of top panel 102 via the anchor hole 132 (see FIG. 1) for connection to the displayed item of goods 150 (see FIG. 1).

In embodiments, the shelf display accessory unit 100 can be used in a method for displaying an item of goods on a shelving system. The method can include providing a shelf display accessory unit, which can include a top surface adapted to display an item of goods, and a bottom surface, opposite to the top surface, having a module that houses a retractable cable. Further, the shelf display accessory unit can include a front surface for displaying a label, wherein the front surface can include a flap for securing the label to the front surface, and a back supporting surface having means for coupling the accessory to the front edge of a shelf, including an upward turning locking lip and at least one screw for coupling the accessory to the front edge of a shelf. The method further can include placing the back supporting surface of the shelf display accessory unit onto a front portion of a shelf, screwing the shelf display accessory unit onto a backside of the front portion of the shelf to secure the shelf display accessory unit to the shelf, and displaying an item of goods on the top surface of the top panel of the shelf display accessory unit. In an aspect of this method, an item of goods can be displayed on the top surface of the shelf display accessory unit. In another aspect of this method, the displayed item of goods can be connected to one end of a retractable cable, while the other end of the retractable cable is anchored to a cable module of the shelf display accessory unit. In one aspect of the embodiment, the means for coupling the shelf display accessory unit can include an upward turning locking lip and at least one screw to secure the accessory unit to the shelf. In one aspect of the embodiment, the flap for securing the label to the front surface can be a spring loaded hinged flap rotably affixed to the forward edge of the shelf display accessory unit to provide a marketing material display.

The invention has been described with respect to certain preferred embodiments, but the invention is not limited only to the particular constructions disclosed and shown in the drawings as examples, and also comprises the subject matter and such reasonable modifications or equivalents as are encompassed within the scope of the appended claims.

We claim:

1. A theft deterrent shelf display accessory unit for displaying an item of goods on a shelving system, comprising:

a shelf comprising a hollow bottom defining a storage space, a top panel having a top surface configured for displaying an item of good and a bottom surface, opposite the top surface, the bottom surface having attached directly thereon a module that houses a retractable cable within the storage space;

a front panel having a display surface that is configured to display a label; side walls and a back wall wherein the front panel, the side walls and the back panel conceal the module;

a spring loaded hinged flap rotably affixed to a front bottom edge of the front panel directly by a spring loaded hinge, wherein the flap secures a label to the front panel; and, the back panel having a supporting surface that includes a channel bracket having a flange that is parallel to the supporting surface, wherein the channel bracket attaches the shelf display accessory to a front edge of a shelf by screwing the shelf display accessory unit onto a backside of the front edge of the shelf to secure the shelf display accessory unit to the shelf; wherein the front edge of the shelf is wedged between the supporting surface and the flange;

wherein when displaying an item of goods on the top surface of the top panel of the shelf display accessory unit, one end of the retractable cable is anchored to the module and the other end is attached to the item of goods in order to prevent the item of goods from being stolen or misplaced.

2. A method for displaying an item of goods on a shelving system, the method comprising: providing a theft deterrent shelf display accessory unit, the theft deterrent shelf display accessory unit including: a shelf comprising a hollow bottom defining a storage space, a top panel having a top surface configured for displaying an item of goods and a bottom surface, opposite the top surface, the bottom surface having attached directly thereon a module that houses a retractable cable within the storage space;

a front panel having a display surface that is configured to display a label; side walls and a back wall wherein the front panel, the side walls and the back panel conceal the module;

a spring loaded hinged flap rotably affixed to a front bottom edge of the front panel directly by a spring loaded hinge, wherein the flap to secures a label to the front panel; and, the back panel having a supporting surface that includes a channel bracket having a flange that is parallel to the supporting surface, wherein the channel bracket attaches the shelf display accessory to a front edge of a shelf by screwing the shelf display accessory unit onto a backside of the front edge of the shelf to secure the shelf display accessory unit to the shelf; wherein the front edge of the shelf is wedged between the supporting surface and the flange;

displaying an item of goods on the top surface of the top panel of the shelf display accessory unit wherein one end of the retractable cable is anchored to the module and the other end is attached to the item of goods in order to prevent the item of goods from being stolen or misplaced.

3. The method of claim 2, further comprising extending at least a portion of the cable outside the module coupled to the shelf display accessory unit.

4. The method of claim 2, further comprising retracting at least a portion of the cable inside the module coupled to the shelf display accessory unit.

* * * * *